United States Patent [19]

Fotland et al.

[11] 4,267,556

[45] May 12, 1981

[54] ELECTROSTATIC TRANSFER PRINTING EMPLOYING ION EMITTING PRINT HEAD

[75] Inventors: Richard A. Fotland; Jeffrey J. Carrish, both of Holliston, Mass.

[73] Assignee: Dennison Manufacturing Company, Framingham, Mass.

[21] Appl. No.: 969,517

[22] Filed: Dec. 14, 1978

Related U.S. Application Data

[63] Continuation-in-part of Ser. No. 844,913, Oct. 25, 1977, abandoned.

[51] Int. Cl.[3] ..... B41M 1/22

[52] U.S. Cl. ..... 346/153.1; 346/155; 346/165; 355/3 R

[58] Field of Search ..... 355/3; 346/153, 155, 346/157, 165

[56] References Cited

U.S. PATENT DOCUMENTS

| | | | |
|---|---|---|---|
| 4,048,921 | 9/1977 | Raschke | 346/153 |
| 4,096,489 | 6/1977 | Terazawa et al. | 346/155 |

*Primary Examiner*—Marshall M. Curtis

*Attorney, Agent, or Firm*—George E. Kersey; Arthur B. Moore

[57] ABSTRACT

Electrostatic transfer printing in which a latent electrostatic image is formed on a cylindrical dielectrical member by means of a remote glow discharge ion source. The image is then toned and pressure-transferred to a receptor, such as a sheet of paper, which is passed between the cylindrical dielectric member and a transfer roller. Scraper blades may be included to remove residual toner from the cylindrical dielectric member and the transfer roller. Means may also be included to erase any latent residual electrostatic image on the cylindrical dielectric member.

8 Claims, 5 Drawing Figures

ELECTROSTATIC TRANSFER PRINTING EMPLOYING ION EMITTING PRINT HEAD

This application is a continuation-in-part of application Ser. No. 844,913, filed Oct. 25, 1977, now abandoned.

BACKGROUND OF THE INVENTION

This invention relates to transfer printing, and more particularly to electrostatic transfer printing.

Various types of electrostatic transfer printers can be found in the prior art. Examples are F. A. Schwertz U.S. Pat. No. 3,023,731; Richmond Perley U.S. Pat. No. 3,701,996; and T. Doi et al, U.S. Pat. No. Re. 28,693. Electrostatic transfer printers may be classified generally according to the way in which the latent electrostatic image is formed. One prior art approach utilizes metal styli at minute distances from the surface of the dielectric transfer drum. The styli are electrically pulsed to provide a latent electrostatic image by air gap breakdown. This technique has the disadvantage of not allowing for multiplexing of the charging styli. In addition, the necessity for maintaining a very small air gap breakdown distance requires extremely close tolerances which limit the practicability of this technique.

Another type of electrostatic printer found in the prior art employs an ion source in the form of a corona point or wire used together with an image defining mask. Because of the inherently low current densities available from corona discharges, this method is impractical for high speed printing. The use of coronas also poses significant difficulties in maintenance. Corona wires are fragile, and because of their high operating potentials, tend to collect dirt and dust. Hence they must be frequently cleaned or replaced.

Another approach to electrostatic transfer printing depends on the method by which the toned image is transferred and fused onto the receptive sheet. The transfer printing system, R. Perley U.S. Pat. No. 3,701,996, teaches simultaneous transfer and pressure fusing by passing a receptive sheet between the transfer and pressure drums. In P. Pederson, U.S. Pat. No. 3,874,894, a nylon-6 sleeve is provided on at least one of a pair of pressure rolls, but the drums are used only for fixing the already transferred toner, an arrangement which adds significant complexity to the overall system.

Accordingly, it is an object of the invention to facilitate electrostatic transfer printing. A related object is to reduce critical mechanical tolerances in providing a latent electrostatic image. Another related object is to reduce the maintenance problems associated with the formation of such an image.

A further object of the invention is to achieve increased electrostatic printing speed. A related object is to do so by using a reliable, easily controlled ion source. A still further object is to achieve relatively uniform charge images which may be toned with good definition and dot fill. A further related object is to provide a matrix selection (or multiplexed) method of dot matrix printing.

Another object of the invention is to achieve a transfer drum with surface resistivity sufficient to prevent image degradation from the time when the image is presented to the surface until the image is toned. Still another object is to utilize a surface with high abrasion resistance, and sufficient smoothness to provide complete transfer of toner to a receptor sheet. A still further object is to realize a transfer surface not subject to significant distortion.

Yet another object is to facilitate the erasure of latent residual electrostatic images. A related object is to avoid ghost images in subsequent printing cycles.

SUMMARY OF THE INVENTION

In accomplishing the foregoing and related objects, the invention provides an electrostatic printing system in which the latent electrostatic image is formed on a cylindrical dielectric member by means of a "glow discharge" ion generator. The latent electrostatic image is then toned to form a visible counterpart which is transferred to a receptor.

In accordance with one aspect of the invention, the glow discharge ion generator includes two electrodes separated by a solid dielectric member. The two electrodes (a "control electrode" and a "driver electrode") are essentially in contact with the solid dielectric member, with an air space at a junction of the control electrode and the solid dielectric member.

In accordance with another aspect of the invention, a high voltage, high frequency discharge is initiated between the two electrodes, creating a pool of negative and positive ions in the air space adjoining the control electrode. In accordance with a related aspect of the invention, an auxiliary direct voltage is applied to the control electrode to extract ions from the pool in order to form the latent electrostatic image on the cylindrical dielectric member.

In a specific embodiment of the invention, the image forming ion generator takes the form of a multiplexed matrix of finger electrodes and selector bars, separated by a solid dielectric layer. Ions are generated at apertures in the finger electrodes at matrix crossover points, and extracted to form an image on the cylindrical dielectric member.

In accordance with a further aspect of the invention, the ion generator is spaced from the cylindrical dielectric member by more than one thousandth of an inch.

The cylindrical dielectric member desirably contacts a transfer roller, with a receptor (such as a sheet of paper) fed between.

The transfer roller is advantageously coated with a stress-absorbing plastics material such as nylon or polyester.

In accordance with yet another aspect of the invention, the surface of the cylindrical dielectric member has a smoothness in excess of 20 micro-inch rms., and a resistivity in excess of $10^{12}$ ohn-centimeters.

The dielectric member can be of a material selected from the class comprising aluminum oxide, glass enamel, and resins including polyimides and nylon.

Other aspects of the invention include a scraper for removing residual toner from the dielectric member, and an eraser unit for eradicating any remaining electrostatic image after tansfer printing has been effected.

In a particular embodiment of the invention, an electrostatic printing system includes a rotatable imaging drum with a conducting core and a dielectric layer. The image is toned and transferred to a receptor by a rotatable pressure drum in contact with the imaging drum, with the receptor passing between the imaging drum and the pressure drum at their point of tangency. Two metal scrapers are disposed adjacent to said drums in order to clean the surface of the drums after image transfer.

Any residual latent image on the imaging drum can be erased by electrodes on both sides of the dielectric layer, between which high frequency AC discharges are induced. Erasure can also be effected by a grounded conductor or grounded semi-conductor maintained in intimate contact with the surface of the dielectric layer. The grounded conductor can be a heavily loaded metal scraper blade, and the grounded semi-conductor can be a semi-conducting roller.

Other aspects of the invention will become apparent after considering the drawings and detailed description below.

DETAILED DESCRIPTION

Figure 1:
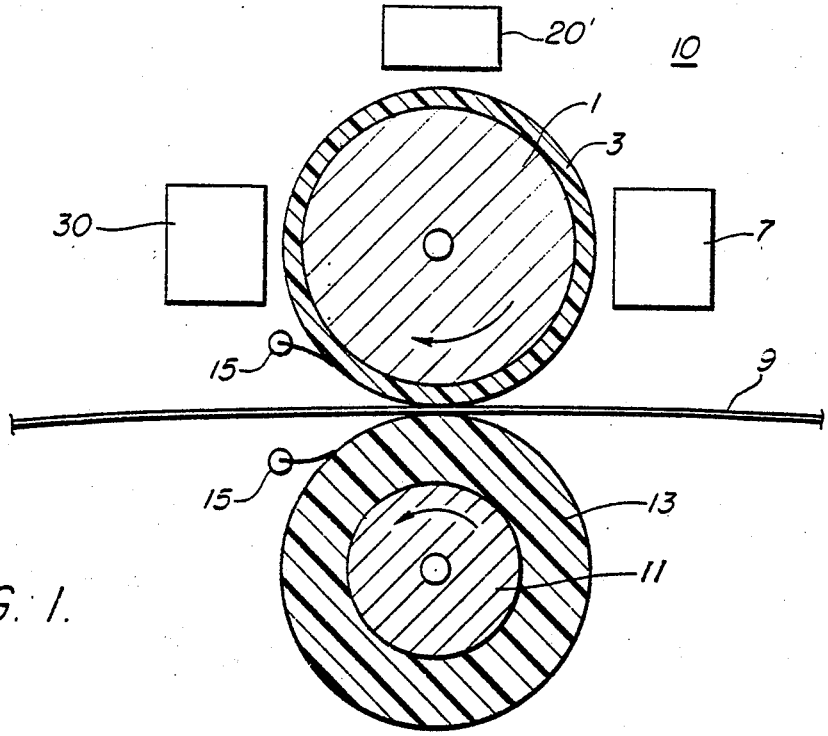
FIG. 1 is a schematic view of an electrostatic transfer printer in accordance with the invention.

An electrostatic printer 10 in accordance with the invention is shown schematically in FIG. 1. The printer 10 is formed by two metallic rollers 1 and 11. The upper roller 1 shown in FIG. 1 is coated with a thin layer 3 of dielectric material, while the lower pressure roller 11 is desirably coated with an engineering thermoplastic material 13. A latent electrostatic image in the pattern of the imprint that is to be made is provided on the dielectric layer 3 by a charging head 20. The latent image is then toned, for example by charged, colored particulate matter, at a station 7, following which the toned image undergoes essentially total pressure transfer with simultaneous fusing to a receptor sheet 9 to form the desired imprint. The electrostatic printer of FIG. 1 desirably includes scraper blades 15 and a unit 30 for erasing any latent residual electrostatic image that remains on the dielectric layer 3 before re-imaging takes place at the charging head 20.

With respect to the individual components of the printer, the roller 1 is provided with a dielectric coating 3 that has sufficiently high resistance to support a latent electrostatic image during the period between latent image formation and toning. Consequently, the resistivity of the layer 3 must be in excess of $10^{12}$ ohm-centimeters. The preferred thickness of the insulating layers 3 is 0.001 to 0.002 inches. In addition, the surface of the layer 3 should be highly resistant to abrasion and relatively smooth, with a finish that is preferably better than 20 micro-inch rms, in order to provide for complete transfer of toner to the receptor sheet 9. The dielectric layer 3 additionally has a high modulus of elasticity so that it is not distorted significantly by high pressures in the transfer nip.

A number of organic and inorganic dielectric materials are suitable for the layer 3. Glass enamel, for example, may be deposited and fused to the surface of a steel or aluminum cylinder. Flame or plasma sprayed high density aluminum oxide may also be employed in place of glass enamel. Plastic materials, such as polyimides, nylons, and other tough thermoplastic or thermoset resins are also suitable. However, the preferred dielectric coating is impregnated, anodized aluminum oxide as described in co-pending patent application Ser. No. 072,521, filed Sept. 4, 1979, which is a continuation-in-part of application Ser. No. 822,865, filed Aug. 8, 1977, now abandoned.

The latent electrostatic image produced on the layer 3 is provided by the charging head 20 by extracting ions from a discharge that is remote from the dielectric surface. A suitable ion generation and extraction technique, as disclosed in U.S. Pat. Nos. 4,153,093 and 4,164,257, involves the generation of ions by high frequency, high voltage discharges between two electrodes separated by a dielectric. Auxiliary fields extract ions from the discharge to charge the surface of dielectric layer 3.

Figure 2:
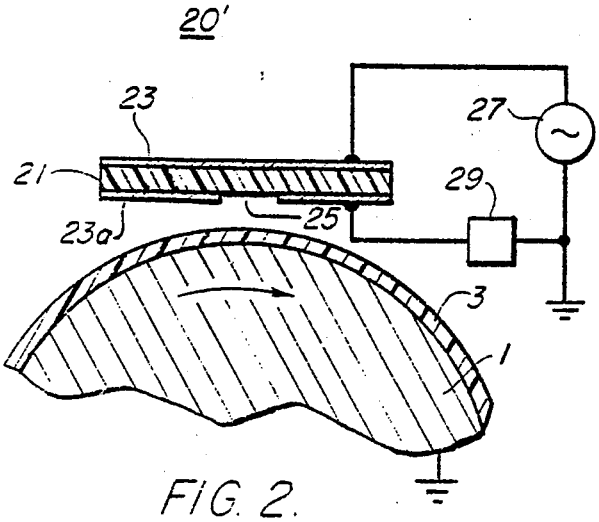
FIG. 2 is a partial sectional view of a generator and ion extractor for the printer of FIG. 1.

In FIG. 2, electrodes 23 and **23*a* are separated by a thin dielectric plate 21. Electrode 23*a* contains an aperture 25 in which a glow discharge is caused to be formed through the application of a high voltage alternating potential supplied by generator 27. Glow discharge is used herein to indicate a silent discharge formed in air between two conductors separated by a solid dielectric (with no spark or arc). In order to charge the surface of dielectric 3, an extraction voltage pulse is supplied between electrode 23*a* and ground via pulse generator 29. Aperture 25 is advantageously disposed above dielectric 3** at a separation of more than one thousandth of an inch.

Suitable materials for dielectric plate 21 include aluminum oxide, glass enamels, ceramics, plastic films, and mica. Aluminum oxide, glass enamels and ceramics present difficulties in fabricating a sufficiently thin layer (i.e. around 1 mil.) to avoid undue demands on generator 27. Plastic films, including polyimides such as Kapton ® and Nylon, tend to degrade as a result of exposure to chemical byproducts of the air gap breakdown process in aperture 25 (notably ozone and nitric acid). Mica avoids these drawbacks, and is therefore the preferred material for dielectric 21. Especially preferred is Muscovite mica, $H_2KAl_3(SiO_4)_3$. In general practice, for dot matrix printing, electrode **23*a*** is provided with a multiplicity of holes. In order to generate a latent electrostatic dot image from any one hole, two potentials must be present simultaneously, the spark discharge potential and the ion extraction potential. This permits dot matrix multiplexing and significantly reduces the number of interconnections and pulse drive sources required for the formation of dot matrix characters.

Figure 5:
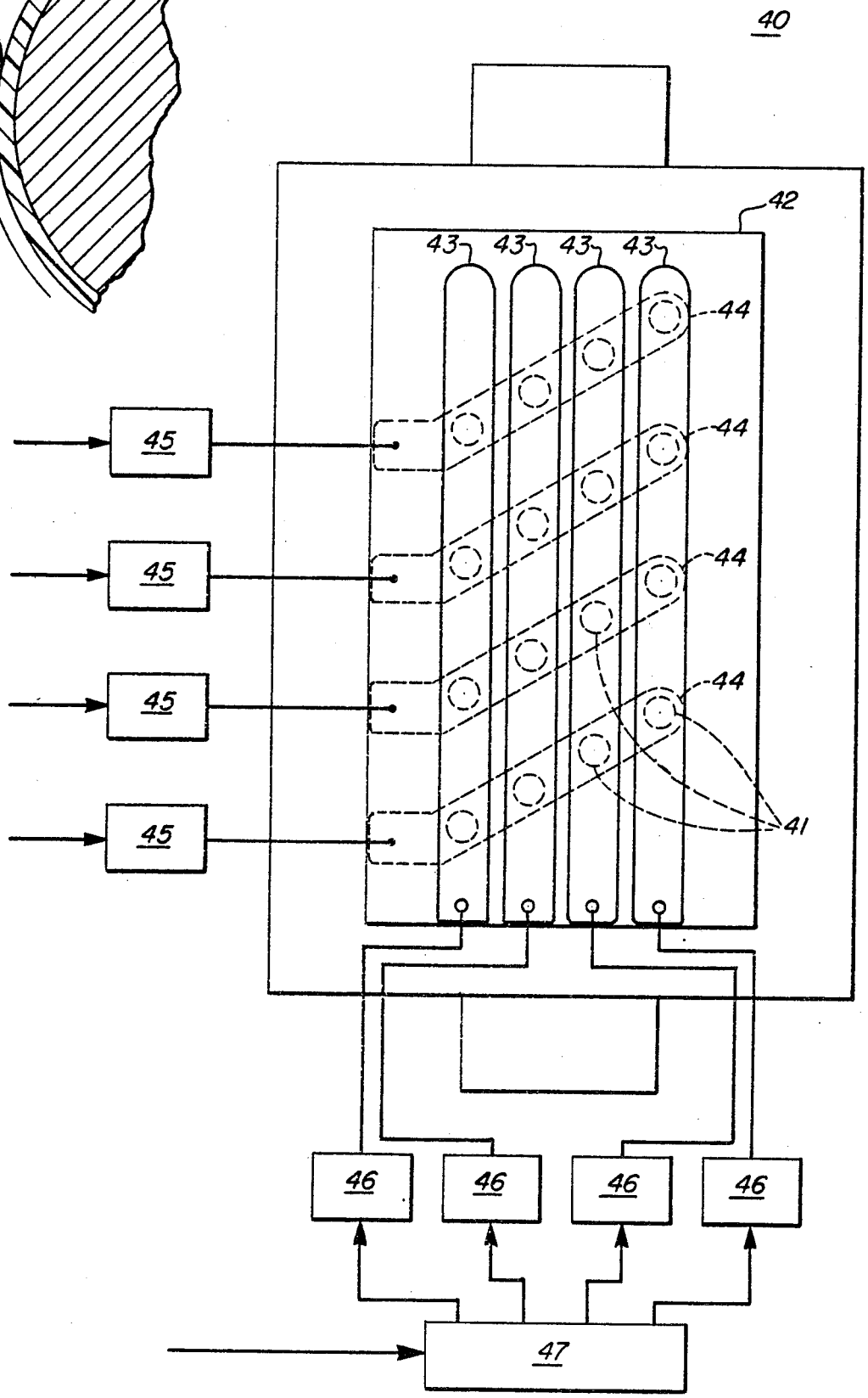
FIG. 5 is a plan view of a multiplexed ion generator of the type shown in FIG. 2.

FIG. 5 shows in a plan view a multiplexed ion generator 40 of the above type. The ion generator 40 includes a series of finger electrodes 44 and a crossing series of selector bars 43 with an intervening dielectric layer 42. Ions are generated at apertures 41 in the finger electrodes at matrix crossover points. Ions can only be extracted from an aperture 41 when both its selector bar is energized by a high voltage alternating potential supplied by one of gated oscillators 46, and its finger electrode is energized by a direct current potential supplied by one of pulse generators 45. The timing of gated oscillators 46 is advantageously controlled by a counter 47.

The latent electrostatic image produced by ion generator 20 is rendered visible by toning at station 7. While any conventional electrostatic toner may be used, the preferred toner is of the single component conducting magnetic type described by J. C. Wilson, U.S. Pat. No. 2,846,333, issued Aug. 5, 1958. This toner has the advantage of simplicity and cleanliness.

The toned image is transferred and fused onto a receptive sheet 9 by high pressure applied between rollers 1 and 11. The bottom roller 11 consists of a metallic core which may have an outer covering of engineering plastic 13. The pressure required for good fusing to plain paper is governed by such factors as, for example, roller diameter, the toner employed, and the presence of any coating on the surface of the paper. Typical pressures range from 100 to 700 lbs. per linear inch of contact. The function of the plastic coating 13 is to absorb any high stresses introduced into the nip in the case of a paper jam or wrinkle. By absorbing stress in the plastic layer 13, the dielectric coated roller 1 will not be damaged during accidental paper wrinkles or jams. Coating 13 is typically a nylon or polyester sleeve having a wall thickness in the range of $\frac{1}{8}$ to $\frac{1}{2}''$. This coating need not be used, for example, if a highly controlled web is printed for which paper wrinkles and jams are not likely to occur.

Scraper blades 15 serve to clean any residual paper or toner dust from the pressure rollers 1 and 11. Since substantially all of the toned image is transferred to the receptor sheet 9, the scraper blades are not required, but are desirable in promoting reliable operation over an extended period.

Figure 3:
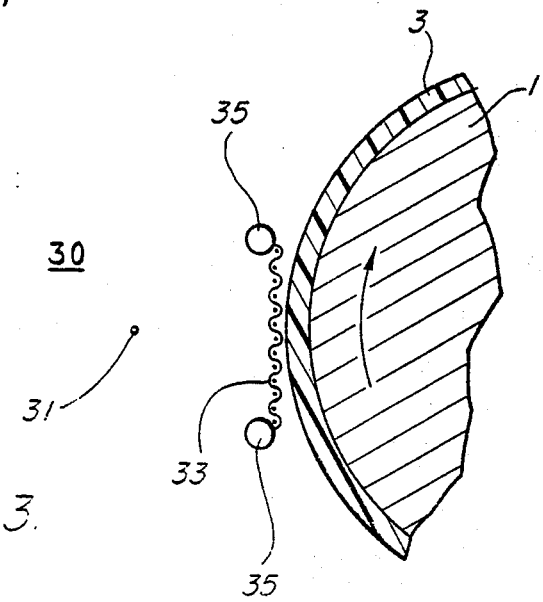
FIG. 3 is a partial sectional view of a charge eraser unit for the printer of FIG. 1.

The electrostatic printer 10 may also include an eraser unit 30 for eliminating any latent electrostatic image. The action of toning and transferring a toned latent image to a plain paper sheet reduces the magnitude of the electrostatic image, typically from several hundred volts to several tens of volts. In some cases, if the toning threshold is too low, the presence of a residual latent image will result in ghost images on the copy sheet, which are eliminated by the eraser unit 30. Such erasure may be performed with arrangement 30 of FIG. 3. In FIG. 3, the metal roller 1, with a dielectric coating 3, is maintained in contact with, or a short distance from, an open mesh screen 33, maintained at substantially the same potential as the conducting cylinder 1. The screen is mounted on holder 35, and an AC corona wire 31 is positioned behind the screen at a distance of typically $\frac{1}{4}$ to $\frac{1}{2}''$. A high voltage alternating potential, illustratively 60 Hertz, is applied to the wire 31. The screen 33 establishes a reference ground plane near the dielectric surface and the AC corona wire 31 supplies both positive and negative ions. Any local field at the screen 33 due to a latent electrostatic image on the dielectric surface 3 attracts ions generated by the corona wire 31 onto the dielectric layer, thus neutralizing the majority of any residual charge. At very high surface velocities of dielectric coating 3, the remaining charge can again result in ghost images. In this case, multiple discharge stations will further reduce the residual charge to a level below the toning threshold.

Alternatively, erasure of any latent electrostatic image can be accomplished by using a high frequency AC discharge between electrodes separated by the dielectric as described in U.S. Pat. No. 4,155,093.

The latent residual electrostatic image may also be erased by contact discharging. The surface of the dielectric must be maintained in intimate contact with a grounded conductor or grounded semi-conductor in order effectively to remove any residual charge from the surface of the dielectric layer 1, for example, by a heavily loaded metal scraper blade. The charge may also be removed by a semi-conducting roller which is pressed into intimate contact with the dielectric surface.

Figure 4:
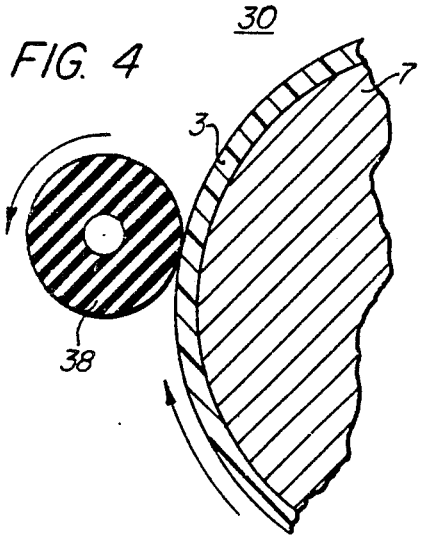
FIG. 4 is a partial sectional view of a charge eraser unit for the printer of FIG. 1 in accordance with an alternative embodiment of the invention.

FIG. 4 shows a partial sectional view of a semiconductor roller 38 in rolling contact with dielectric surface 3. Roller 38 advantageously has an elastomer outer surface.

While various aspects of the invention have been set forth by the specification, it is to be understood that the foregoing detailed description is for illustration only and that various changes in parts, as well as the substitution of equivalent constituents for those shown and described, may be made without departing from the spirit and scope of the invention as set forth in the appended claims.

We claim:

1. Electrostatic printing apparatus comprising:

a cylindrical dielectric member having a conductive core and a dielectric surface layer;

means for generating ions comprising:

a solid dielectric member, a first electrode substantially in contact with one side of said solid dielectric member, a second electrode substantially in contact with an opposite side of said solid dielectric member, with an edge surface of said second electrode disposed opposite said first electrode to define an air region at the junction of said edge surface and said solid dielectric member, and means for applying an alternating potential between said first and second electrodes of sufficient magnitude to induce ion producing electrical discharges in said air region between the dielectric member and the edge surface of said second electrode;

an externally applied field between said first electrode and the conductive core of the cylindrical dielectric member, whereby ions are extracted from said generating means to form a latent electrostatic image on said cylindrical dielectric member;

means for toning said latent electrostatic image to form a visible counterpart thereof; and a pressure transfer roller which contacts said cylindrical dielectric member with an image receptor fed therebetween.

2. Apparatus as defined in claim 1 wherein the generating means and extracting means are spaced from said cylindrical dielectric member by more than one thousandth of an inch.

3. Apparatus as defined in claim 1 wherein the generating means and extracting means are multiplexible, and include a multiplicity of electrodes forming crosspoints in a matrix array and separated by a dielectric member configured such that all electrodes on one side of said dielectric member contain apertures at matrix electrode crossover regions.

4. Apparatus as defined in claim 1 wherein said pressure transfer roller is coated with a stress-absorbing plastics material.

5. Apparatus as defined in claim 4 wherein the stress-absorbing material is of nylon or polyester.

6. Apparatus as defined in claim 1 wherein said cylindrical dielectric member has a smoothness in excess of about 20 micro-inch rms. and a resistivity in excess of about $10^{12}$ ohm centimeters.

7. Apparatus as defined in claim 6 wherein the cylindrical dielectric member comprises a conductive core with a dielectric layer thereon, said dielectric layer having a thickness of more than one thousandth of an inch.

8. Apparatus as defined in claim 1 wherein said cylindrical dielectric member is of a material selected from the class comprising aluminum oxide, glass enamel and resins including polyamides and nylon.

* * * * *